United States Patent [19]

Briley

[11] 4,386,477

[45] Jun. 7, 1983

[54] SHOTGUN CHOKE MODIFIER AND METHOD

[76] Inventor: Jess Briley, 1085 Gessner C, Houston, Tex. 77055

[21] Appl. No.: 275,300

[22] Filed: Jun. 19, 1981

[51] Int. Cl.[3] ..... F41C 21/00

[52] U.S. Cl. ..... 42/79

[58] Field of Search ..... 42/79, 76 R; 89/14 B, 89/14 C, 14 D, 14 E

[56] References Cited

U.S. PATENT DOCUMENTS

| | | | |
|---|---|---|---|
| 1,858,560 | 5/1932 | Rosenstiel | 42/79 |
| 2,807,903 | 10/1957 | Wheeler | 42/79 |
| 3,797,155 | | Smith et al. | 42/79 |
| 4,058,925 | 11/1977 | Linde et al. | 42/79 |

FOREIGN PATENT DOCUMENTS

| | | | |
|---|---|---|---|
| 679744 | 1/1965 | Italy | 42/79 |

*Primary Examiner*—Charles T. Jordan
*Assistant Examiner*—Ted L. Parr
*Attorney, Agent, or Firm*—Pravel, Gambrell, Hewitt, Kirk & Kimball

[57] ABSTRACT

A method for forming a counter bore in the bore of a shotgun barrel and a choke tube insert for the counter bore. The insert includes an internal surface formed with a choke constriction for modifying the choke of the shotgun barrel and threads on its external surface for engaging complementary threads formed in the counter bore. Complementary angles are formed between the inner end of the choke tube and a ledge on the counter bore for preventing powder residue from accumulating between the threads. The method includes the steps of inserting a portion of a shotgun barrel in a frame and potting the barrel in a material which has a melting point substantially below the temperature which would affect the bluing of a shotgun barrel, but which when solidified rigidly holds the barrel when a counter bore is being reamed in its bore. The barrel is positioned in a lathe for aligning the centerline of the barrel with the cutting line of the lathe and a counter bore is reamed in the bore with substantially the same centerline as the bore. Threads are formed along at least a portion of the length of the counter bore and the potting material is removed by heating it above its melting point but below the temperature which would affect the bluing of the barrel.

8 Claims, 7 Drawing Figures

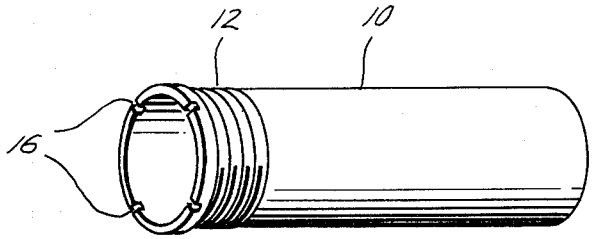
Fig. 1
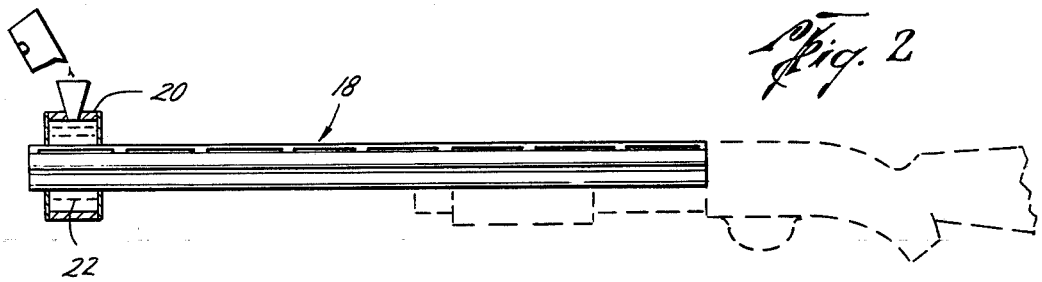
Fig. 2
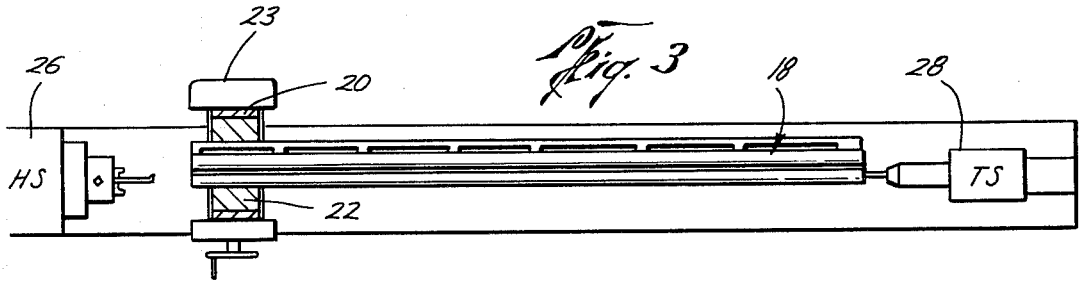
Fig. 3
Fig. 4
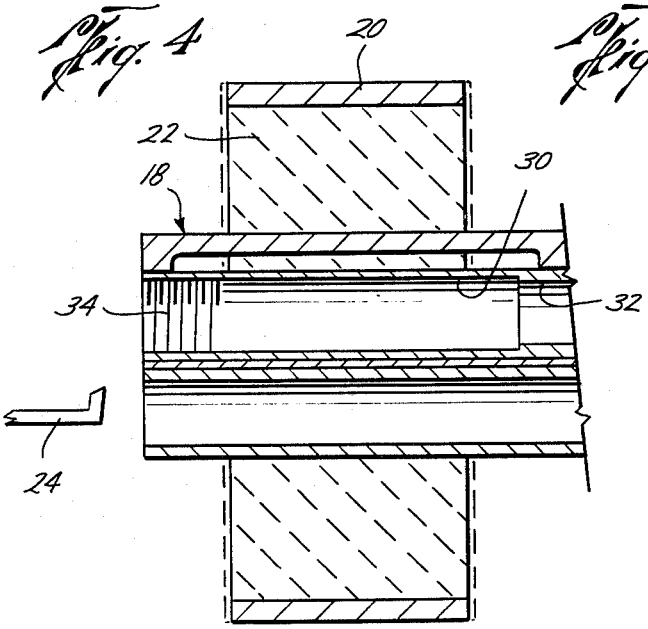
Fig. 5
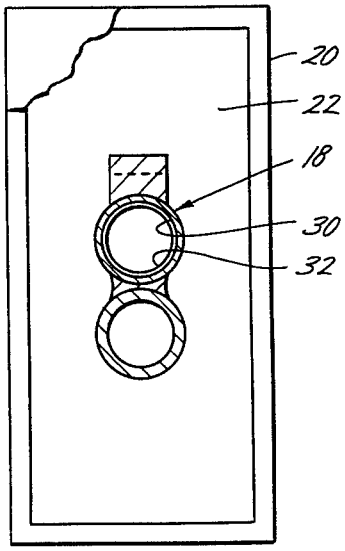

SHOTGUN CHOKE MODIFIER AND METHOD

BACKGROUND OF THE INVENTION

This invention relates to modifying the choke of a shotgun barrel and, more particularly, to novel interchangeable choke tubes which can selectively be screwed into the end of a shotgun barrel for providing a range of different choke constrictions for the barrel and a method for preparing the internal surface of a barrel for accommodating such choke tubes.

Shotgun barrels are normally formed with a smooth bore that is either cylindrical along its entire length or has a slight choke constriction at its outer end. Choke modifying devices are available which vary the constriction in the outer end of the barrel for changing the pattern of pellets leaving the barrel. Since each use of a shotgun, from skeet shooting to hunting various types of game, has an optimum choke which controls pellet density and pattern size at a given distance, a shotgun with variable chokes is more versatile than a shotgun with only a single choke.

Many types of choke modifiers have been developed in the past, but they have proven to be less than satisfactory because of their limited applicability, poor performance or impractical expense. For example, many choke modifiers are formed with bulbous appendages which are connected to the outer surface of a barrel. These devices are clumsy and usable only on single-barreled guns and not on double-barrel shotguns of either a side-by-side or over-under design. Another type of choke modifier requires expanding a shotgun barrel to accommodate an insertable tube, which also precludes use in most double-barrel shotguns where the barrels are positioned close together. Other choke modifiers which fit into a counter bore formed in the barrel have been tried, but like many of the other devices mentioned above, satisfactory alignment between the choke modifier and the bore has proven difficult to achieve. Such non-alignment can adversely affect the density of the pellets and their flight pattern and, in addition, cause excessive wear to the barrel and choke modifier.

An attempt to solve this latter problem is taught in U.S. Pat. No. 4,058,925 where the shortcomings of a choke modifier formed independently of a shotgun are discussed. The patent indicates that a number of manufacturing tolerances can affect the alignment of the choke with the bore, such as (1) angularity of threads in a counter bore to the barrel bore; (2) angularity of the outside diameter of a choke tube to the inside diameter of the tube; (3) tolerances of thread pitch diameter on both barrels; (4) concentricity of bore to counter bore in barrel; (5) concentricity of outside diameter of choke tube to inside diameter of choke tube; (6) diameter of bore; and (7) diameter of choke in tube. Inaccuracies in these tolerances are indicated as causing the bore of the choke tube not to be aligned with the bore in the shotgun barrel.

U.S. Pat. No. 4,058,925 proposes to eliminate these tolerance problems by forming a permanent choke constriction in a barrel and during the same operation form a series of detachably mounted, progressively reduced choke tubes which can selectively be removed to form different choke constrictions. By forming the barrel and choke tubes together the tolerance inaccuracies are supposedly reduced to the point where alignment is satisfactory. The obvious disadvantage of this procedure, however, is that choke tubes can only be used with one shotgun, the one they were formed with, and the method cannot be used to form choke modifiers for the many shotguns already in use. Further, if one or more of the tubes become lost or damaged, usable replacements cannot be made. It is also believed that satisfactory alignment is not totally achievable by this method because if the choke tubes are formed before the barrel is completed (including adding the bluing to the barrel) slight distortions occur during final stages of manufacturing which can cause alignment problems.

SUMMARY OF THE INVENTION

In accordance with the invention, the problems discussed above have been solved by providing one or more novel choke tubes which can be threaded into a counter bore formed by a novel method. The subject method virtually assures that a threaded counter bore formed in a shotgun barrel is concentric with the bore. A series of accurately machined, thinwalled, choke tubes are adapted to be inserted into the counter bore and provide a full range of choke constrictions, for example, from ⅛ to full choke. These tubes can be used in any type of shotgun which has been prepared in accordance with the instant invention, so that the choke tubes need not be formed when the barrel is manufactured.

A shotgun barrel is prepared to accommodate such choke tube inserts by first positioning the outer end of a shotgun barrel in a frame and then potting the barrel in a material which has a melting point below the temperature which would affect the bluing of a shotgun barrel but which when solidified rigidly holds the barrel when a counter bore is being reamed. Such a potting material should have a melting point no greater than 400° C., which is the upper limit for most solders. A preferable material is a low temperature bismuth alloy known as Wood's metal which has a melting point of about 150° C. After the barrel is potted, the frame is positioned in a lathe for aligning the center line of the barrel with the cutting line of the lathe. This is preferably done by a standard machine shop technique where the barrel is aligned in two planes for accurate positioning of the barrel.

A counter bore is reamed in the barrel concentric with the bore. A single point tool is preferably used which minimizes cutting thrust and torque which helps to maintain the accuracy and concentricity of the counter bore. The inner end of the counter bore includes a ledge formed at an acute angle (relative to the bore) for reasons discussed in greater detail below.

Threads are formed in the outer end of the counter bore, also by using a single point tool. The threads are truncated to provide a strong connection between the thin walls of choke tube and barrel without sacrificing strength. After the threads are formed the barrel is removed by heating the potting material above its melting point.

Tubes adapted for insertion into the counter bore for modifying the choke of the shotgun are formed of a high strength stainless steel. Such tubes can be formed of a solid bar which is cut into a tube by first reaming out an inner diameter which is tapered along either all or part of its length. A plug is placed in the tapered portion of the inner diameter of the tube for supporting it while the cylindrical outer surface is formed.

Threads are formed on the outer surface of the tube which are compatible with the threads in the counter bore. The inner end of the tube is formed at an angle complementary with the angle formed on the ledge of the inner end of the counter bore so that when the angled surfaces engage each other the thin stainless steel wall of the tube is forced to flare slightly outward as the tube is threaded into the bore to form a gas tight seal between the angled surfaces for preventing powder residue from accumulating between the threads.

The wall thickness of the choke tube at its inner end is less than the width of the counter bore so that the inner end of the choke tube does not project into the bore and interfere with pellets traveling through the bore. A number of choke tubes can be formed with different constrictions so that a shotgun prepared with a counter bore as described above can be modified throughout a full range of choke constrictions.

By utilizing the method described above, a counter bore can be formed in a shotgun barrel with enough accuracy that a carefully machined choke tube can be inserted therein which is virtually concentric with the shotgun bore. In this way, almost any shotgun can be adapted for use with a set of these interchangeable choke tubes which are so closely aligned with the shotgun bore that shot patterns remain intact. These choke tubes are particularly useful because when they are inserted a casual observer will not even notice them. Compared with modifiers of a similar quality which are formed when the barrel is manufactured, the subject tubes have the advantages of being less expensive, adaptable to almost any shotgun and replaceable if lost or damaged.

BRIEF DESCRIPTION OF THE DRAWINGS

A better understanding of the invention can be obtained when the detailed description of preferred embodiments set forth below is considered in conjunction with the following drawings, in which:

FIG. 1 is a perspective view of a choke tube which is the subject of the instant invention;

FIG. 2 is a schematic view showing the end of a shotgun barrel being potted in accordance with the inventive method;

FIG. 3 is a schematic view of the barrel potted as shown in FIG. 2 held in place in a lathe;

FIG. 4 is a section view of the end of the barrel of an over-under shotgun in which a counter bore has been formed in one barrel in accordance with the invention and a machine tool is aligned and ready to form a counter bore in the other barrel;

FIG. 5 is an end view, partially in section, of the barrel of FIG. 4;

DETAILED DESCRIPTION OF PREFERRED EMBODIMENTS

FIG. 1 shows a choke sleeve or tube 10 which is partially the subject of the instant invention and which is adapted to be inserted into the end of a shotgun barrel in which a compatible threaded counter bore has been formed as described in detail below. The choke tube 10 is formed of a high strength stainless steel, preferably 1741 precipitation hardened stainless steel. The tube 10 is formed on a lathe by first reaming a tapered inner diameter in a solid bar using a solid carbide boring bar.

Figure 6:
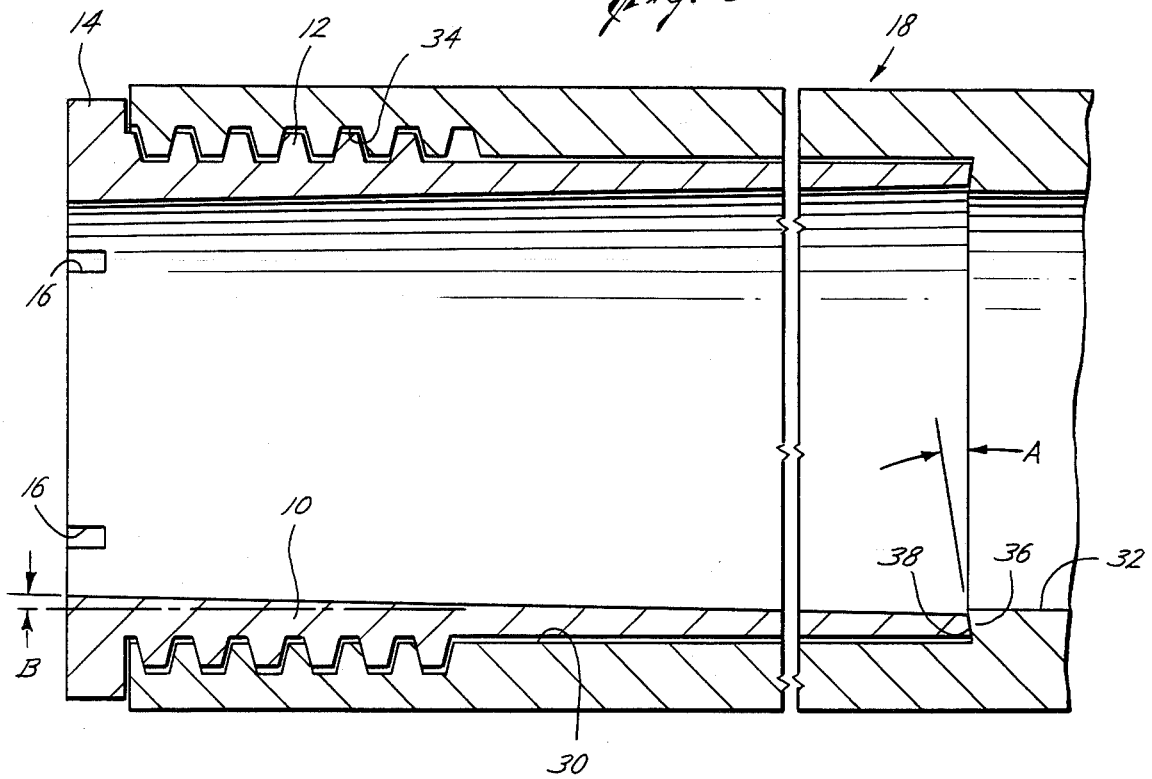
FIG. 6 is a side section view of the end of a shotgun barrel with a tube choke inserted in a counter bore formed in the barrel, the choke tube illustrating one embodiment of the invention where the tube overlaps the end of the shotgun barrel and the inner surface of the tube is tapered along its entire length.
Figure 7:
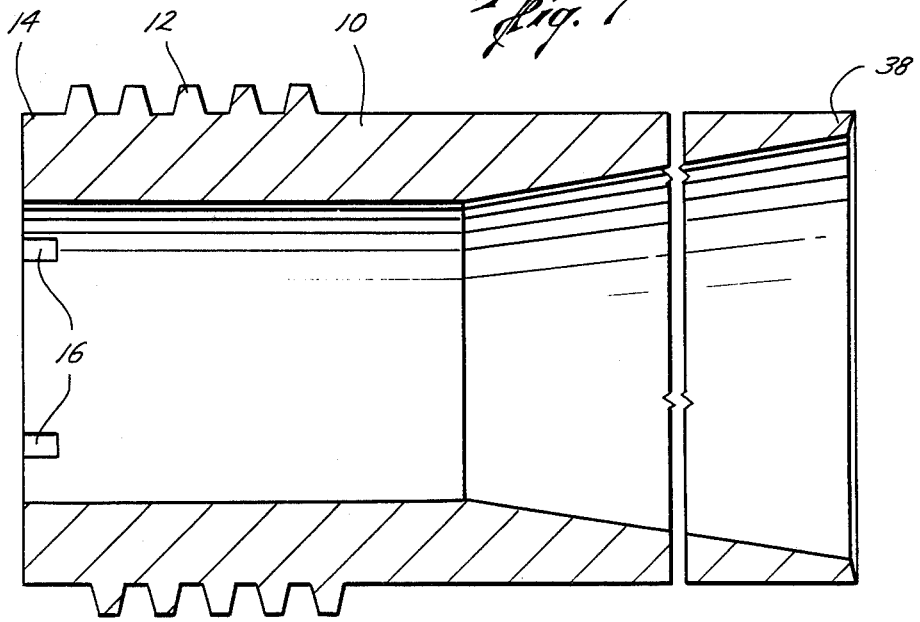
FIG. 7 illustrates another embodiment of a choke tube where the end of the tube is designed to be flush with the end of the shotgun barrel and the inner surface of the tube is only tapered along a portion of its overall length.

After the internal diameter is reamed, which can either be tapered along its entire length as shown in FIG. 6 or along only a portion of its length as shown in FIG. 7, the tapered portion is plugged and the external surface formed. A series of truncated threads 12 which are described in greater detail below are formed on the outer portion of the external surface of the tube 10. All the lathing operations are performed by using a single point machine tool to ensure the accuracy of the surfaces. The outer end of the tube 10 is formed with a rim 14 which can either overlap the end of a shotgun barrel (see FIGS. 1 and 6) or be formed to be flush with the end of the barrel (see FIG. 7). A number of notches 16 are formed in the rim 14 so that an appropriate wrench (not shown) can be used to tighten or loosen the tube 10.

As mentioned above, prior art choke modifiers were generally unsatisfactory because they either fit over the end of the barrel so that they could not be used on double-barrel shotguns and/or they could not be formed accurately enough for the modifier to be concentric with the shotgun bore which resulted in excessive wear and distorted shot patterns. Choke modifiers formed at the same time as a barrel had the disadvantages discussed above. FIGS. 2–5 show various steps of the invention method where the bore of almost any shotgun can accurately be reamed to accommodate a tube of the type shown in FIG. 1.

As shown in FIG. 2, the end of a shotgun barrel which is generally designated by reference numeral 18 is inserted into a steel box or frame 20 and potting material designated generally by reference numeral 22 is poured into the box for holding the end of the barrel 18 rigidly in place. The potting material is preferably a low temperature alloy such as, for example, a bismuth alloy known as Wood's metal that has a melting temperature of about 150° C. Other potting materials can be used which rigidly hold the end of a shotgun barrel 18 in place during the reaming process and which preferably do not have a melting temperature higher than 400° C. which is the upper limit for most solders.

As shown in FIG. 3, the frame 20 is clamped in a chuck 23 of a lathe so that the barrel 18 can be aligned with a cutting tool held in the headstock 26 of a lathe. The other end of the barrel 18 is held in place by a tail stock indicated by reference numeral 28. The barrel 18 is aligned using known machine shop techniques. The tool 24 is preferably a single point, solid carbide, cutting tool.

As shown best in FIG. 4, a counter bore 30 is reamed in the outer end of a bore 32 of the barrel 18. For a typical 12-gauge shotgun which has a barrel that has an outer surface 0.800–0.820" in diameter and a bore 0.720–0.735" in diameter, a counter bore is reamed which is about 0.750" in diameter. The counter bore is approximately 3 inches long with about the outer 1 inch being threaded as indicated by reference numeral 34 and discussed below.

The threads 34, also formed with a single point solid carbide cutting tool, are preferably coarse pitch threads. A truncated thread is particularly suited for this application because thread depth can be kept at a minimum without any reduction in strength, which is desirable because of the thin walls involved.

Truncated threads with a pitch of about 20 threads/inch have been found satisfactory, whereas standard threads with the same strength would need to have about 40 threads/inch. Other characteristics and dimensions of the threads are discussed in greater detail below.

After the counter bore is completed, the frame 20 is removed from the lathe and the potting material 22 is heated to above its melting point but below the temperature which would affect the bluing of the barrel so that the barrel can be removed from the frame 20.

Referring to FIG. 6, which shows in exaggerated fashion a choke tube 10 fully inserted in a counter bore 30, it will be noticed that the threads 12 on the choke tube 10 and the threads 34 on the counter bore 30 are complementary. Each thread is approximately 0.008" wide and about 0.005" deep. There is approximately 0.001" clearance between the two sets of the threads 12 and 34. The sides of each thread are sloped at about a 30° angle.

As mentioned above, the inner end of the counter bore 30 is formed as a ledge 36 that is oriented at an acute angle relative to the bore 32, the angle designated by letter A being preferably about 2°. The inner end 38 of the choke tube 10 is formed at a complementary angle to that of the ledge 36 so that when the choke tube 10 is fully inserted into the counter bore 30 (as shown in FIG. 6) the end 38 engages the ledge 36 and causes the threads to tighten. The end 38 tends to flare slightly and the engaged surfaces 36 and 38 form a gas-type seal to prevent powder residue from accumulating between the threads. As shown in FIG. 6, the thickness of the inner end 38 of the choke tube 10 is less than the width of the counter bore so that the inner end does not project into the bore 32 and interfere with pellets traveling through the bore.

As shown in FIG. 6, the outer end of the choke tube 10 can be formed with a rim 14 that overlaps the outer end of the barrel 18. The rim includes a plurality of notches 16 designed to receive a wrench (not shown) for tightening and untightening the choke tube 10. As shown in FIG. 7, the outer end of the choke tube 10 can alternatively be formed with a rim 14 that is flush with the outer end of the shotgun barrel.

As also shown in FIGS. 6 and 7, the internal surface of the choke tube 10 tapers inwardly from the end 38 to the outer end (as indicated by the angle B—B shown in FIG. 6) to form a constriction for providing the desired choke in the barrel. The internal surface of the choke tube 10 can taper inwardly along its entire length as shown in FIG. 6 or it can taper along a portion of its length with the remainder being cylindrical in shape as shown in FIG. 7. A typical choke tube is about 3" long. A tube of the design shown in FIG. 7 can be formed with a 2" taper and a 1" cylindrical section.

For either choke tube design, a set of coke tubes can include, for example, eight different tubes providing varying degrees of choking capability. For a 12-guage shotgun, for example, with a bore diameter of approximately 0.735" the outermost end of the tapered portion can have the following constrictions:

| Choke Rating | Tube Diameter |
|---|---|
| ⅛ (skeet) | .725" |
| ¼ | .720" |

-continued

| Choke Rating | Tube Diameter |
|---|---|
| ⅜ | .715" |
| ½ (modified) | .710" |
| ⅝ | .705" |
| ¾ | .700" |
| ⅞ | .695" |
| 1 (full choke) | .690" |

It has been found that the choke tube described above, when inserted in a counter bore formed in accordance with the above method, is aligned accurately enough with the shotgun bore to overcome problems encountered by prior art choke modifiers described above. Since the tubes can be adapted for virtually any shotgun barrel they are more versatile than any of those in the prior art. If a tube is lost or damaged, a new one can easily be made to replace it, which cannot be done when tubes are formed the same time the barrel is formed. Since modifying the choke is a simple matter of removing one tube and replacing it with another one, a shotgun choke can be modified in very little time and provide a shotgun with the versatility of a full range of choke constrictions.

The foregoing disclosure and description of the invention are illustrative and explanatory and various changes in size, shape and materials as well as in the details of the illustrated method and construction may be made without departing from the spirit of the invention. All such changes and variations are contemplated as falling within the scope of the appended claims.

I claim:

1. A choke tube insert for modifying the choke of a shotgun barrel, the bore of which includes a counter bore that has been threaded along at least a portion of its length, the inner end of the counter bore including a ledge formed at an acute angle relative to the bore, the choke tube comprising:

(a) an elongated, hollow, metal tube adapted to be inserted in the counter bore;

(b) threads on the external surface of the tube which are compatible with the threads in the counter bore;

(c) the inner end of the tube including an angle complementary with the angle of the counter bore ledge so that when the threads on the tube engage the threads in the counter bore and the tube is fully inserted in the counter bore the complementary angled surfaces engage each other and form a gas tight seal for preventing powder residue from accumulating between the threads;

(d) the width of the wall forming the inner end of the tube being narrower than the width of the counter bore so that the inner end of the tube does not project into the bore of the barrel and interfere with pellets traveling through the bore;

(e) at least a portion of the internal surface of the tube tapering inwardly in the direction of its outer end for forming a choke constriction in the shotgun barrel.

2. The choke tube insert of claim 1, wherein the threads include a series of truncated threads formed on the outer end of the external surface of the tube.

3. The choke tube of claim 1, wherein the internal surface of the tube is tapered inwardly along substantially its entire length.

4. The choke tube of claim 1, wherein the internal surface of the tube is tapered inwardly along an inner portion of its length and cylindrical along an outer portion.

5. The choke tube of claim 1, wherein the outer end is formed with a plurality of notches for receiving a wrench.

6. The choke tube of claim 5, wherein the outer end is shaped to overlap the outer end of the barrel when the tube is inserted in the bore.

7. The choke tube of claim 5, wherein the outer end is shaped to be flush with the outer end of the barrel when the tube is inserted on the bore.

8. The choke tube of claim 1, and further including a plurality of interchangeable choke tubes formed with different choke constrictions.

* * * * *